US005987682A

United States Patent [19]

Rossi

[11] Patent Number: 5,987,682

[45] Date of Patent: Nov. 23, 1999

[54] TILE SCRUBBER

[76] Inventor: John L. Rossi, 2113 Finley St., San Jose, Calif. 95132

[21] Appl. No.: 09/026,150

[22] Filed: Feb. 19, 1998

[51] Int. Cl.[6] ..... A46B 13/06

[52] U.S. Cl. ..... 15/24; 4/903

[58] Field of Search ..... 15/24, 29; 4/606, 4/903; 285/8

[56] References Cited

U.S. PATENT DOCUMENTS

| | | | |
|---|---|---|---|
| 785,824 | 3/1905 | Nicholls | 285/8 |
| 978,461 | 12/1910 | Linegar | 15/24 |
| 1,059,136 | 4/1913 | Gafney | 15/24 |
| 1,819,157 | 8/1931 | Fitter | 285/8 |
| 2,304,114 | 12/1942 | Moore | 285/8 |
| 2,723,407 | 11/1955 | Bardon . | |
| 2,744,271 | 5/1956 | Florence | 15/29 |
| 3,431,573 | 3/1969 | Frandsen . | |
| 3,515,413 | 6/1970 | Beall | 285/8 |
| 3,909,867 | 10/1975 | Hogsell | 15/24 |
| 4,089,079 | 5/1978 | Nicholson | 15/29 |
| 4,282,623 | 8/1981 | Gacuzana | 15/29 |
| 4,370,771 | 2/1983 | Gonzalvo | 15/29 |
| 4,597,127 | 7/1986 | Swanson | 15/24 |
| 5,028,077 | 7/1991 | Hurst | 285/8 |
| 5,517,705 | 5/1996 | Jackson | 4/606 |
| 5,864,912 | 2/1999 | Zhadanov | 15/24 |

FOREIGN PATENT DOCUMENTS

| | | | |
|---|---|---|---|
| 147109 | 9/1954 | Sweden | 15/24 |
| 44716 | 6/1908 | Switzerland | 285/8 |
| 6196 | 1/1888 | United Kingdom | 285/8 |
| 4664 | 2/1912 | United Kingdom | 285/8 |

*Primary Examiner*—Randall E. Chin

[57] ABSTRACT

A cleaning apparatus is provided including a brush assembly adapted to emit water therefrom upon the receipt thereof. Also included is a hose connected to the brush assembly. Next provided is an elastomeric cover connected to the hose and further releasably securable to a water outlet of a bathing stall.

1 Claim, 2 Drawing Sheets

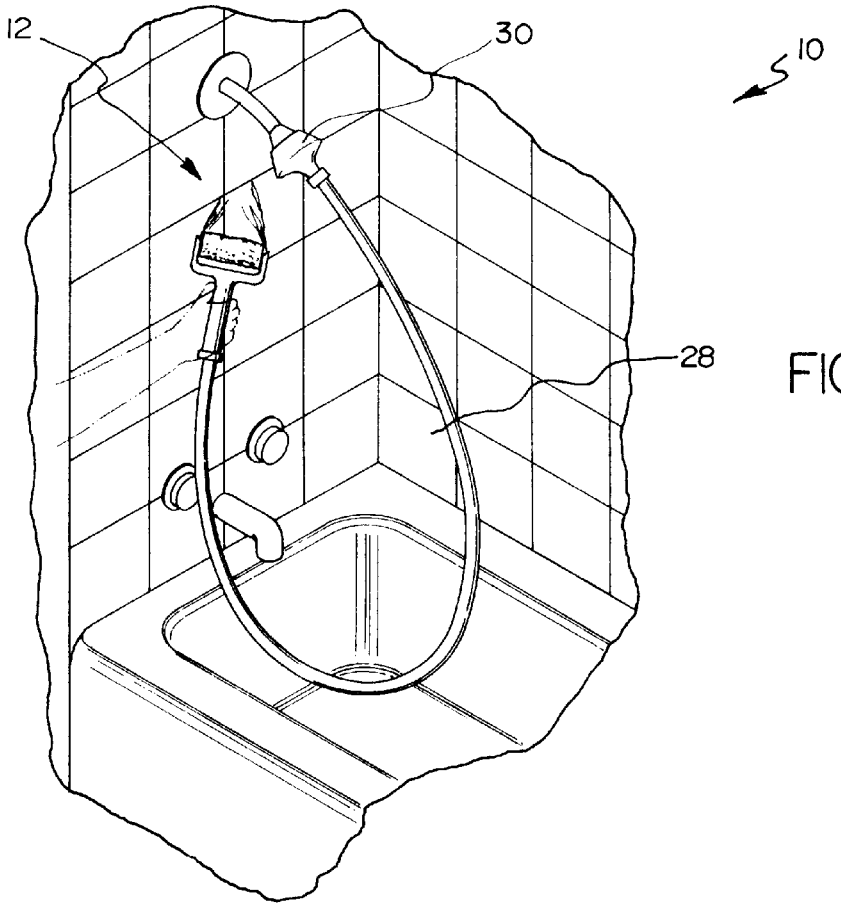
FIG. 1
FIG. 2
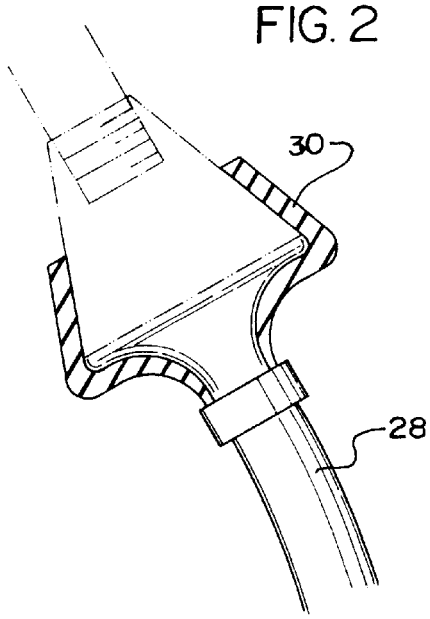
FIG. 6
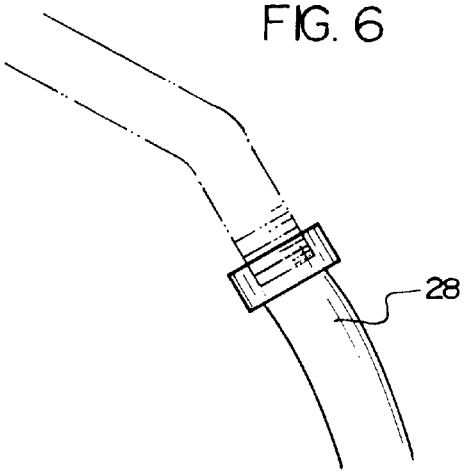

TILE SCRUBBER

BACKGROUND OF THE INVENTION

1. Field of the Invention

The present invention relates to scrub brushes and more particularly pertains to a new tile scrubber for conveniently cleaning a shower stall using water from a shower head.

2. Description of the Prior Art

The use of scrub brushes is known in the prior art. More specifically, scrub brushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art scrub brushes include U.S. Pat. No. 4,057,353; U.S. Pat. No. 3,989,391; U.S. Pat. No. 3,271,809; U.S. Pat. No. 2,793,379; U.S. Pat. Des. 331,840; and U.S. Pat. No. 4,004,312.

In these respects, the tile scrubber according to the present invention substantially departs from the conventional concepts and designs of the prior art, and in so doing provides an apparatus primarily developed for the purpose of conveniently cleaning a shower stall using water from a shower head.

SUMMARY OF THE INVENTION

In view of the foregoing disadvantages inherent in the known types of scrub brushes now present in the prior art, the present invention provides a new tile scrubber construction wherein the same can be utilized for conveniently cleaning a shower stall using water from a shower head.

The general purpose of the present invention, which will be described subsequently in greater detail, is to provide a new tile scrubber apparatus and method which has many of the advantages of the scrub brushes mentioned heretofore and many novel features that result in a new tile scrubber which is not anticipated, rendered obvious, suggested, or even implied by any of the prior art scrub brushes, either alone or in any combination thereof.

To attain this, the present invention generally comprises a brush assembly, as shown in FIGS. 3 & 4. As shown in such Figures, the brush assembly includes a hollow rigid mount having an inboard extent with a linear cylindrical configuration. The inboard extent has a first end with a cylindrical sleeve having a threaded interior surface rotatably coupled thereto. An outboard extent of the brush assembly is equipped with a U-shaped configuration and a thin rectangular cross-section. A central extent of the outboard extent is coupled to a second end of the inboard extent in communication therewith. The outboard extent has a pair of slits formed in ends thereof. As shown in FIG. 4, the slits are resident about planes which intersect in front of the brush assembly. The brush assembly further includes a cylindrical scrub brush having a rigid rod coupled thereto in concentric relationship therewith. The rod has ends rotatably coupled adjacent to and between the ends of the outboard extent of the mount. The ends of the rod extend within the outboard extent of the brush assembly. A pair of water wheels are fixed to ends of the rod within the brush assembly for rotating the scrub brush upon the flow of water through the first end of the inboard extent of the mount and out the slits of the outboard extent thereof. Note FIG. 5. Next provided is an elongated flexible hose having a first end with a threaded outer surface for being releasably coupled to the sleeve of the brush assembly. A second end of the hose has a cylindrical sleeve with a threaded interior surface rotatably coupled thereto. Lastly, a shower head couple is provided including a flexible elastomeric cover. The cover has an inboard portion with a hollow frusto-conical configuration. An outboard portion of the cover is equipped with a cylindrical configuration. As shown in FIG. 2, the outboard portion of the shower head couple has a threaded outer surface. By this structure, the outboard portion of the shower head couple may be releasably coupled to the sleeve of the flexible hose such that the inboard portion of the shower head couple may be removably secured about a shower head of a shower stall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tile scrubber apparatus and method which has many of the advantages of the scrub brushes mentioned heretofore and many novel features that result in a new tile scrubber which is not anticipated, rendered obvious, suggested, or even implied by any of the prior art scrub brushes, either alone or in any combination thereof.

It is another object of the present invention to provide a new tile scrubber which may be easily and efficiently manufactured and marketed.

It is a further object of the present invention to provide a new tile scrubber which is of a durable and reliable construction.

An even further object of the present invention is to provide a new tile scrubber which is susceptible of a low cost of manufacture with regard to both materials and labor, and which accordingly is then susceptible of low prices of sale to the consuming public, thereby making such tile scrubber economically available to the buying public.

Still yet another object of the present invention is to provide a new tile scrubber which provides in the apparatuses and methods of the prior art some of the advantages thereof, while simultaneously overcoming some of the disadvantages normally associated therewith.

Still another object of the present invention is to provide a new tile scrubber for conveniently cleaning a shower stall using water from a shower head.

Even still another object of the present invention is to provide a new tile scrubber that includes a brush assembly adapted to emit water therefrom upon the receipt thereof. Also included is a hose connected to the brush assembly. Next provided is an elastomeric cover connected to the hose and further releasably securable to a water outlet of a bathing stall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new tile scrubber according to the present invention.

FIG. 2 is a side cross-sectional view showing the attachment of the present invention to a shower head via the shower head couple.

FIG. 6 is a side view of the present invention being mounted directly to a pipe associated with the shower head.

DESCRIPTION OF THE PREFERRED EMBODIMENT

Figure 3:
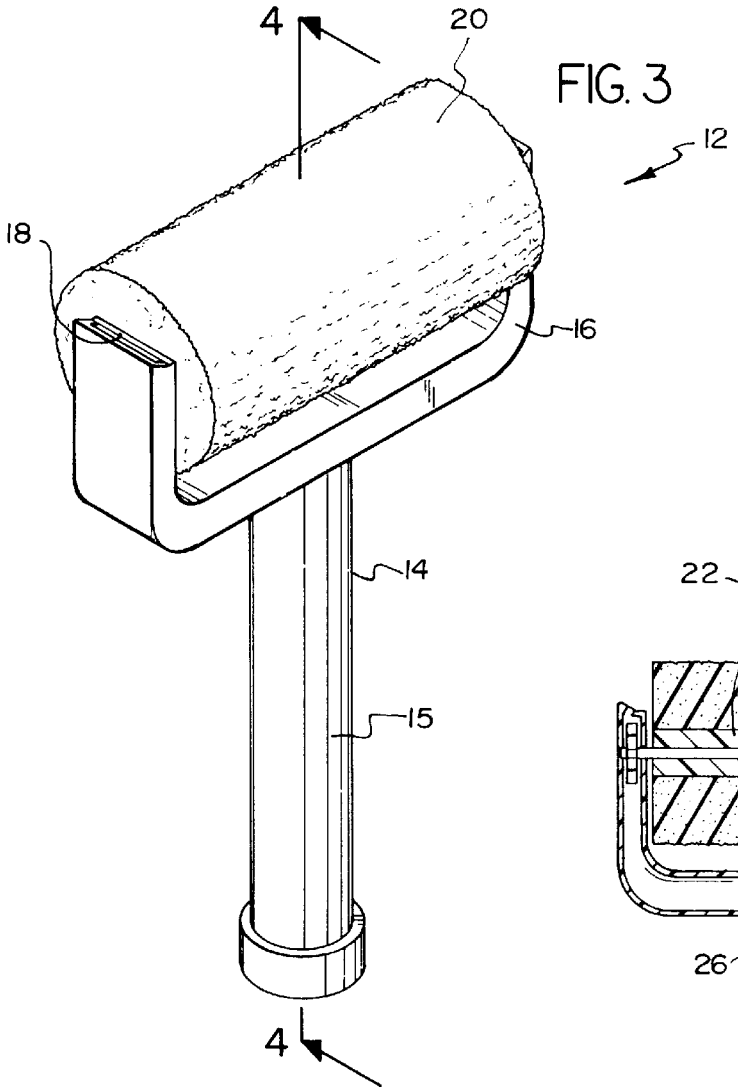
FIG. 3 is a perspective view of the brush assembly of the present invention.

With reference now to the drawings, and in particular to FIGS. 1 through 6 thereof, a new tile scrubber embodying the principles and concepts of the present invention and generally designated by the reference numeral 10 will be described.

Figure 4:
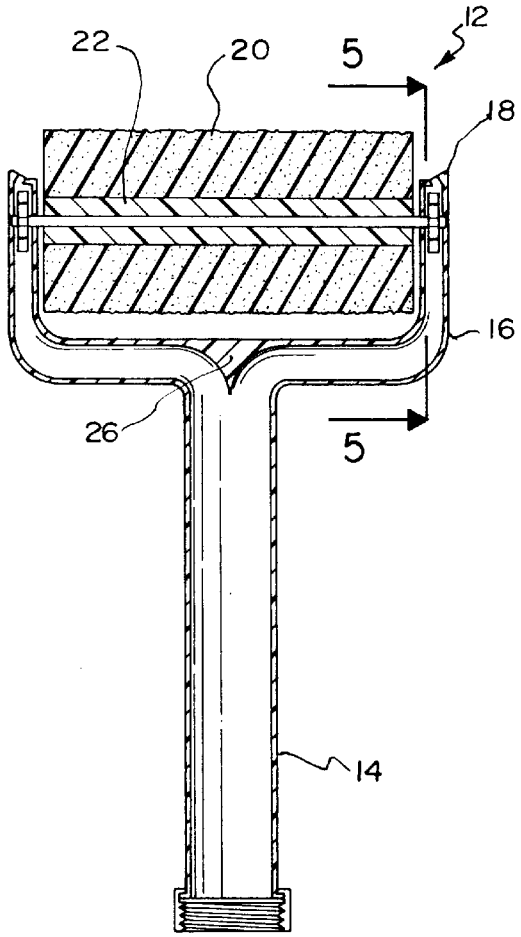
FIG. 4 is a cross-sectional view of the present invention taken along line 4—4 shown in FIG. 3.

The present invention, designated as numeral 10, includes a brush assembly 12, as shown in FIGS. 3 & 4. As shown in such Figures, the brush assembly includes a hollow rigid mount 14 having an inboard extent 15 with a linear cylindrical configuration. The inboard extent has a first end with a cylindrical sleeve rotatably coupled thereto with a threaded interior surface.

An outboard extent 16 of the brush assembly is equipped with a U-shaped configuration and a thin rectangular cross-section. A center of the outboard extent is coupled to a second end of the inboard extent in communication therewith. It should be noted that the inboard and outboard extents of the mount remain in a common plane. The outboard extent has a pair of slits 18 formed in ends thereof. As shown in FIG. 4, the slits are resident about planes which intersect in front of the brush assembly. Ideally, the slits are of a substantial depth so as to define channels. Further, the slits each have a length equal to that of the outboard extent.

Figure 5:
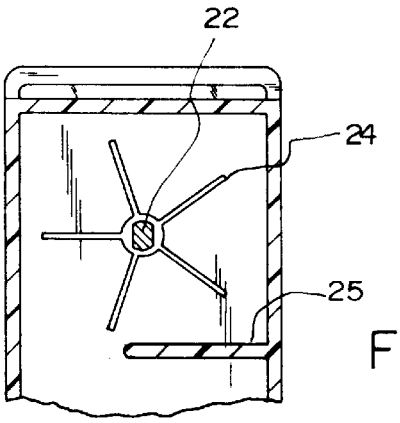
FIG. 5 is a cross-sectional view of the present invention taken along line 5—5 shown in FIG. 4 showing one of the water wheels of the present invention.

The brush assembly further includes a cylindrical scrub brush 20 having a diameter which is greater than a length of the sides of the outboard extent of the mount. A rigid rod 22 is coupled to the scrub brush in concentric relationship therewith. The rod has ends rotatably coupled adjacent to and between the ends of the outboard extent of the mount. The ends of the rod extend within the outboard extent of the brush assembly. A pair of water wheels 24 are fixed to such ends of the rod within the brush assembly for rotating the scrub brush upon the flow of water through the first end of the inboard extent of the mount and out the slits of the outboard extent. As shown in FIG. 5, each water wheel includes a plurality of radially extending fins. In order for the fins to be spun only in a single direction, a wall 25 may be mounted within the outboard extent. Note FIG. 5. Ideally, a V-shaped mold 26 is mounted to the center of the outboard extent for evenly directing the water through both slits.

Next provided is an elongated flexible hose 28 having a first end with a threaded outer surface for being releasably coupled to the sleeve of the brush assembly. A second end of the hose has a cylindrical sleeve rotatably coupled thereto with a threaded interior surface. In the preferred embodiment, both sleeves are rotatably mounted via annular flanges.

Lastly, a shower head coupler 30 is provided including a flexible elastomeric cover. The cover has an inboard portion with a hollow frusto-conical configuration. An outboard portion of the cover is equipped with a cylindrical configuration. As shown in FIG. 2, the outboard portion of the shower head coupler has a threaded outer surface.

By this structure, the outboard portion of the shower head coupler may be releasably coupled to the sleeve of the flexible hose such that the inboard portion of the shower head coupler may be removably secured about a shower head of a shower stall. As shown in FIG. 2, the cover extends along one half a length of the shower head. In an alternate mode of operation, the shower head is removably coupled to a pipe having an outboard end with a threaded outer surface. Such threaded outer surface of the pipe may be screwably secured directly to the sleeve of the hose thereby obviating the need for the shower head water sa shown in FIG. 6.

As to a further discussion of the manner of usage and operation of the present invention, the same should be apparent from the above description. Accordingly, no further discussion relating to the manner of usage and operation will be provided.

With respect to the above description then, it is to betrealized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A shower stall cleaning apparatus comprising, in combination:

a brush assembly including a hollow rigid mount having an inboard extent with a linear cylindrical configuration including a first end with a cylindrical sleeve having a threaded interior surface rotatably coupled thereto and an outboard extent having a U-shaped configuration and a thin rectangular cross-section with a central extent thereof coupled to a second end of the inboard extent in communication therewith, the outboard extent having a pair of slits formed in ends thereof with the slits being aligned along planes which intersect in front of the brush assembly, the brush assembly further including a cylindrical scrub brush having a rigid rod coupled thereto in concentric relationship therewith, the rod having ends rotatably coupled adjacent to and between the ends of the outboard extent of the mount, wherein the ends of the rod extend within the outboard extent of the brush assembly whereat a pair of water wheels are fixed for rotating the scrub brush upon the flow of water through the first end of the inboard extent of the mount and out the slits of the outboard extent thereof;

an elongated flexible hose having a first end with a threaded outer surface for being releasably coupled to the sleeve of the brush assembly and a second end having a cylindrical sleeve with a threaded interior surface rotatably coupled thereto; and a shower head coupler including a flexible elastomeric cover having an inboard portion with a hollow frusto-conical configuration and an outboard portion with a cylindrical configuration, the outboard portion of the shower head coupler having a threaded outer surface, whereby the outboard portion of the shower head coupler may be releasably coupled to the sleeve of the flexible hose such that the inboard portion of the shower head coupler may be removably secured about a shower head of a shower stall for receiving water therefrom, wherein the shower head is removably coupled to a pipe having an outboard end with a threaded outer surface for being screwably secured to the cylindrical sleeve of the hose upon of the shower head being removed.

* * * * *